US006712779B1

(12) United States Patent
Iverson

(10) Patent No.: US 6,712,779 B1
(45) Date of Patent: Mar. 30, 2004

(54) EXERCISE AND MASSAGE HOOP

(76) Inventor: Wendy I. Iverson, 6918 Keonan Cir., Mequon, WI (US) 53092

( * ) Notice: Subject to any disclaimer, the term of this patent is extended or adjusted under 35 U.S.C. 154(b) by 0 days.

(21) Appl. No.: 09/697,273

(22) Filed: Oct. 26, 2000

Related U.S. Application Data

(60) Provisional application No. 60/161,375, filed on Oct. 26, 1999, now abandoned.

(51) Int. Cl.[7] ..... A61H 15/00; A63B 19/00

(52) U.S. Cl. ..... 601/134; 601/136; 446/236

(58) Field of Search ..... 601/136–138, 601/132, 118, 134; 446/236, 450, 28, 237, 490, 239, 241; 402/126; 482/110, 131; D21/457, 701, 703

(56) References Cited

U.S. PATENT DOCUMENTS 3,079,728 A * 3/1963 Melin ..... 446/236
4,690,401 A * 9/1987 Cho ..... 482/122
5,004,226 A 4/1991 Brown, Jr.
D342,294 S * 12/1993 Kirkland ..... D21/101
5,342,273 A 8/1994 Plendl et al.
5,538,454 A 7/1996 Kessler
5,823,846 A 10/1998 Arriola et al.

* cited by examiner

*Primary Examiner*—Danton D. DeMille
*Assistant Examiner*—Quang D Thanh
(74) *Attorney, Agent, or Firm*—Timothy J. Martin; Michael R. Henson; Rebecca A. Gegick

(57) ABSTRACT

A hoop device for aerobic exercise and massage that includes a rigid weighted core that is preferably constructed of a steel rod or tube that is configured into an annular shape and a sleeve constructed of a soft foam material that surrounds the core forming a hoop. The hoop is placed around a waist or other body part of a user to travel around the body part upon rotation providing exercise with the foam sleeve to cushion the effect of the core against the body. The sleeve can also have circumferential ribs separated by circumferential troughs to provide knob-like undulations to massage the user while rotating the device around his or her body.

19 Claims, 1 Drawing Sheet

EXERCISE AND MASSAGE HOOP

CROSS-REFERENCE TO RELATED APPLICATIONS

This application claims the benefit of U.S. Provisional Application No. 60/161,375, filed Oct. 26, 1999, now abandoned.

FIELD OF THE INVENTION

The present invention broadly relates to exercise devices adapted for fitness training of individuals. More particularly, the present invention is directed to an exercise device that is directed to having an overall aerobics and coordination training effect. Specifically, the present invention is directed to a weighted hoop-shaped exercise device.

BACKGROUND OF THE INVENTION

Since mankind first began to have available leisure time, a broad range of sporting and exercise activities have drawn interest both from men and women. Among these diversions include a wide variety of games and sports. Many sporting activities, such as running, wrestling, swimming, etc. do not rely on the particular use of props. On the other hand, some sports and leisure activities employ simple props, such as balls, bats, clubs, rackets and even more complex instruments.

Historically, most of human population relied on manual labor in order to survive. As a result, the normal daily routine of most persons provided sufficient exercise to maintain a healthy body. In modern times, the movement away from intensive manual labor has caused a decline of the normal exercise received by many segments of the population. This is true for both assembly line workers and office personnel. Accordingly, there has been an increasing focus of attention on leisure time exercise.

While many persons actively participate in a variety of leisure time exercise programs, such activities normally take place at specialized facilities. Participation requires the individual to travel to such facilities, and it becomes all too easy to skip an exercise session. Home exercise equipment, on the other hand is often expensive, cumbersome and takes up excessive space in the dwelling.

Another disadvantage of exercise regimens is that they are often boring endeavors. Although calisthenics, such as push-ups, sit-ups, leg lifts, etc. are quite good exercise regimens, many persons simply find them boring. Therefore, it is a challenge to find exercise activities that are more enjoyable.

In addition to these considerations, it is advisable for most persons to engage in low impact exercise such as aerobics and aquatics. Such activities are favored in that they more gently stretch, tone and exercise the muscle groups. The present invention is directed to a low impact aerobic-type activity that is designed to be fun and entertaining during participation.

SUMMARY OF THE INVENTION

It is an object of the present invention to provide a new and useful exercise device that is fun and entertaining for an individual to use.

It is another object of the present invention to provide a simple and inexpensive aerobic exercise device.

Another object of the present invention is to provide an aerobic exercise device that can readily be used in one's own home yet which requires a minimal amount of space for use and storage.

Still another object of the present invention is to provide an exercise device that massages the body while helping tone and strengthen the muscles.

According to the present invention, then, device is provided for exercising the human body. Broadly, the device according to the present invention includes a core configured in an annular shape and constructed of a rigid, first material. The core is received in a sleeve constructed with a second material that is relatively soft such that the core and the sleeve define a hoop that may be placed around a body part of the user. The user may then rotate the hoop by movement of the body. The core operates to supply a weight for exercising a body part while the sleeve operates to cushion the affect the core against the body part during rotation.

Preferably, the core is constructed of a solid steel rod having a circular cross-section although it is contemplated that the core be constructed of a hollow steel tube. Alternatively, other heavy, rigid materials such as plastics, metals (other than steel) and the like may be employed for the construction of the core. In any event, it is preferred that the rod is bent into an annular shape with the opposite rod ends being welded together. Where the core is a solid steel rod, it preferably has a diameter of between 0.335 inches (0.85 centimeter) and 0.415 inches (1.0 centimeter). Moreover, it is desired that the hoop have an internal radius of between 12 inches (30.5 centimeter) and 20 inches (51.0 centimeter).

The sleeve is preferably elongated and has opposite sleeve ends secured together by an adhesive so as to completely encase the core. Moreover, the sleeve preferably has a wall thickness of between 0.363 inches (0.92 centimeters) and 0.513 inches (1.3 centimeters). The material used to construct the sleeve may either frictionally grip the core or be loose-fitted about the core. Preferably the sleeve is constructed of a medium density, closed-cell polyvinyl chloride foam material such as that known as 700-Grip material. If desired, the external surface of the sleeve may be undulated in construction to provide for protrusions that project radially inwardly of the hoop. These circumferential ribs may be provided by a plurality of separate circumferential ribs spaced-apart by a plurality of circumferential troughs. Alternatively, a spiral thread-like rib may extend around the hoop.

The present invention is also directed to a method of exercising the human body. Here, the method includes the steps of placing a hoop around a body part of a user, such as the waist, wherein the hoop is formed by a rigid core of a first material and an outer sleeve of a soft material. Next, the hoop is rotated by movement of the body so that the hoop travels around the body part.

The present invention is also is directed to a method of forming the above-described exercise device. Here, the method includes forming an elongated, rigid but bendable member having opposite ends into an annular shape. The annular member is inserted into a sleeve of foam material that has opposite sleeve ends. Next, the ends of the elongated member are connected after it is connected after it is inserted into the sleeve. Finally, the sleeve ends are joined together after the ends of the elongated member are connected together.

The method according to the present invention may include the step of using a lubricating powder to facilitate insertion of the elongated member into the sleeve. Where the member is steel, the step of connecting is preferably accomplished by welding. The method may include the step of protecting the sleeve ends during welding by forcing them apart a sufficient distance so that the ends of the steel member may be welded together; thereafter, the sleeve ends are brought back together after the weld has cooled.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to an exercise device in the form of a hoop that may be placed around the waist or other body part of a user so that it travels around the body part upon rotation. As described below, this hoop is weighted and may be made in various weight ranges so as to require greater energy to rotate. The weight and construction materials also serve to aerobically exercise and massage the body of the user.

Figure 1:
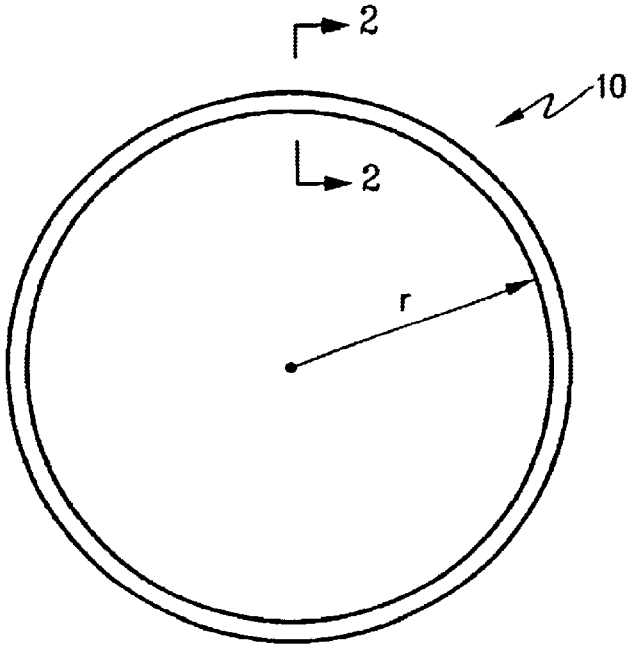
FIG. 1 is a top plan view showing the exercise hoop device accordingly to a first exemplary embodiment of the present invention.
Figure 2:
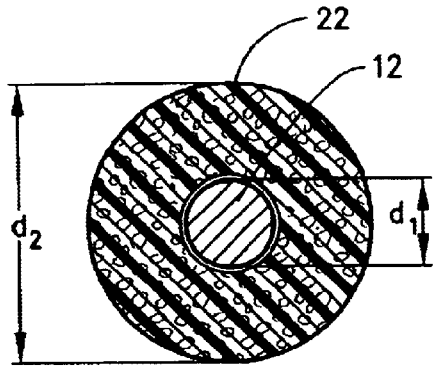
FIG. 2 is an enlarged cross-sectional view taken about lines 2—2 of FIG. 1.
Figure 3:
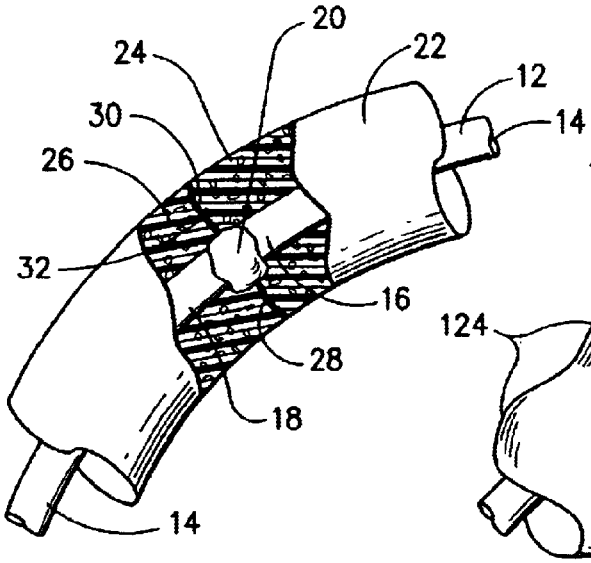
FIG. 3 is an enlarged view, partially broken away, showing a segment of the exercise device of FIG. 1.

As is shown in FIG. 1, a first exemplary embodiment of the present invention is in the form of a large hoop device 10 having an internal radius "r" that may be of any selected size but that preferably is within a range of about 12" (30.5 cm) to 20" (51 cm). With reference to FIGS. 2 and 3, it may be seen a solid annular core 12 that is constructed preferably from a relatively heavy, rigid material, such as steel, forms that hoop device 10. It is desirable that this material be sufficiently stiff to hold the shape of the hoop and be slightly resilient to not be subject to deformed during use. While the rod is shown to be solid, it should be understood that the core 12 could be formed out of a hollow tubular material.

Core 12, in the embodiment shown in FIGS. 1–3, is constructed of a first material, and is preferably a steel rod 14 that is configured into an annular shape and has its opposite ends 16 and 18 fastened together such as by weldment 20. Other construction materials could be different metals, fiberglass, and plastics. In any event, steel rod 14 has a diameter of approximately 0.335" (0.85 cm) to 0.415" (1 cm) although it could be understood that smaller and larger diameters are within the scope of this invention. Naturally, the larger diameter steel will typically result in a hoop having a greater weight unless the cross-sectional dimension is changed. In any event, it is preferred that the diameter of rod 14 be approximately 0.375" (0.95 cm).

Rod 14 is surrounded by an elongated sleeve 22 of a second material that is soft, and is preferably made of a resilient foam material that has a weight less than that of the core 12, and the device can be constructed such that rod 14 is relatively gripped by sleeve 22 through friction. Alternatively, rod 14 can be loosely fitted relative to sleeve 22. Sleeve 22 is best illustrated in FIGS. 2 and 3 where it may be seen that sleeve 22 has an internal cross-sectional diameter "$d_1$" that is preferably the same as the diameter of steel rod 14. Thus, "$d_1$" is in a range of approximately 0.335" (0.85 cm) to 0.415" (1 cm) although it could be understood that smaller and larger diameters are within the scope of this invention. Naturally, the larger diameter steel will typically result in a hoop having a greater weight. In any event, it is preferred that the diameter of rod 14 be approximately 0.375" (0.95 cm). Sleeve 22 has an outer diameter "$d_2$" that is preferably about 1.25" (3.18 cm). This results in a wall thickness preferably of about 0.438" (1.11 cm). However, it should be understood that the wall thickness of sleeve 22 may be varied as desired. For example, wall thicknesses of 0.363" (0.92 cm) to 0.513" (1.3 cm) have been found acceptable.

It is preferred that sleeve 22 be constructed of a medium density closed-cell polyvinyl chloride foam material such as that known as 700 grip available from Rubatex Corporation in Roanoke, Va. Other foam or sponge-like materials are also within the scope of this invention. By using closed-cell foam material, however, the foam sleeve will be less likely to absorb moisture and dirt and must be easier to maintain and clean. Moreover, the sponginess of close-cell foam provides a desired rebound as the exercise hoop is used. This foam material also serves to cushion the effect of the weighted steel rod 14 against body parts, such as hipbones, leg bones, etc.

To assemble hoop device 10, the selected steel rod or other rigid member is bent into an annular shape, as noted above. Prior to welding ends 16 and 18 together, a suitable length of the sleeve 22 material is fed around the circular rod 14 wherein the rod is inserted into the sleeve 22, until opposite sleeve 22 ends 24 and 26 are in confronting relation. To facilitate insertion of rod 14 through the internal passageway of sleeve 22, talcum powder or other lubricating powder may be used. At this point, ends 24 and 26 are forced apart a sufficient distance so that ends 16 and 18 may be welded together with sleeves 22 in place. It is important to thermally protect ends 24 and 26 during the welding operation to avoid melting the foam material. After ends 16 and 18 are welded together, by weldment 20, and the weld has cooled, ends 24 and 26 are brought back together. The confronting faces 28 and 30 of ends 24 and 26 are now joined or secured together by means of any suitable adhesive 32. Where other materials are used to construct core 12, the opposite ends can be joined after being bent into the circular shape by those techniques generally used in the industry.

Figure 4:
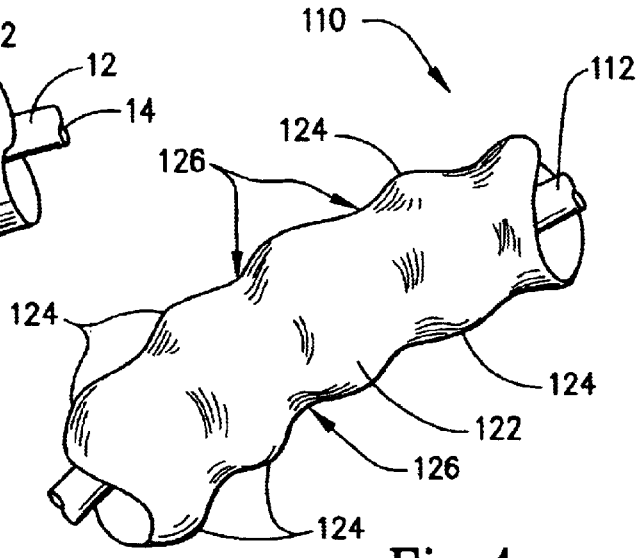
FIG. 4 is a perspective view of a segment of a first alternative embodiment of the exercise device accordingly to the present invention.

A first alternative embodiment of the present invention is shown in FIG. 4. Here, a section of an alternative construction of a hoop device 110 is shown wherein a heavy core 112 such as a steel rod is again used. Sleeve 122 is positioned over rod 112 in the manner described with respect to the embodiment shown in FIGS. 1 and 3, however, the outer surface of sleeve 122 is configured differently. Sleeve 122 has an external surface that is undulated an appearance to provide protrusions on the radially inward portion and preferably has a plurality of circumferential ribs 124 which are separated by a plurality of circumferential troughs 126 to provide knob-like undulations. The variation in the diameter of sleeve 122 provides an undulating area of contact with the body of the user when the hoop device 110 is employed. These knobs or undulations act to massage the user at the same time the user is exercising. Naturally, it should be understood that other configurations of the sleeve could be made in order to provide massaging structures. For example, the ribs and troughs could be a single spiral thread extending the length of the sleeve.

Accordingly, the present invention has been described with some degree of particularity directed to the exemplary embodiment of the present invention. It should be appreciated, though, that modifications or changes may be made to the exemplary embodiments of the present invention without departing from the inventive concepts contained herein.

I claim:

1. A method of aerobic exercise and massage, comprising the steps of:

(a) placing a hoop around a body part of a user wherein said hoop is formed by a rigid core of a first material and an outer sleeve of a soft foam material loosely fitted about said core; and (b) rotating said hoop by movement of the user so that it travels around the body part of the user.

2. A method of aerobic exercise and massage according to claim 1 wherein said sleeve is rotatable disposed about said core.

3. A device adapted for exercising a human body, comprising:

(a) a core configured in an annular shape and constructed of a first material that is rigid; and (b) a movable sleeve surrounding said core and constructed of a second material that is soft, said sleeve has an external surface that is undulated in construction to provide protrusions on a radially inward portion thereof, whereby the core and sleeve define a hoop that adapted to be placed around a body part of a user and rotated by movement of the body, said core operative to supply weight for exercising the body part and said sleeve operative to cushion the effect of said core against said body part upon rotation therearound.

4. A device according to claim 3 wherein said hoop has an internal radius between 12 inches (30.5 cm) and 20 inches (51.0 cm).

5. A device according to claim 3 wherein said core is constructed of a hollow steel tube.

6. A device according to claim 3 wherein said sleeve has a wall thickness between 0.363 inches (0.92 cm) and 0.513 inches (1.3 cm).

7. A device according to claim 3 wherein said core is constructed as a rod having opposite rod ends, said rod being bent into said annular shape with said opposite rod ends being welded together.

8. A device according to claim 3 wherein said sleeve is elongated and has opposite sleeve ends secured together by an adhesive.

9. A device according to claim 3 wherein said hoop has a cross-sectional diameter of about 1.25 inches (3.18 cm).

10. A device according to claim 3 wherein said core is constructed of steel rod having a circular cross-section.

11. A device according to claim 10 wherein said steel rod has a diameter between 0.335 inches (0.85 cm) and 0.415 inches (1.0 cm).

12. A device according to claim 3 wherein said sleeve is constructed of a medium density closed-cell polyvinyl chloride foam material.

13. A device according to claim 12 wherein said sleeve is constructed of 700-grip material.

14. A device according to claim 1 wherein said sleeve has a plurality of circumferential ribs separated by a plurality of circumferential troughs to provide knob-like undulations that act to massage the user at the same time the user is exercising.

15. A device according to claim 3 wherein said sleeve is rotatably disposed about said core.

16. A hoop that may be placed around a body part of a user and rotated by movement of the body, comprising:

(a) a core configured in an annular shape and constructed of a first material that is rigid and operative to supply weight for exercising the body part; and (b) a sleeve surrounding said core and constructed of a second material that is soft and includes a rib that spirals around the hoop.

17. A method of forming an exercise device comprising the steps of:

(a) forming an elongated member having opposite ends into an annular shape;

(b) inserting said member into a sleeve of foam material that has opposite sleeve ends and that is sized and adapted to be movably disposed about said member;

(c) welding the ends of said member together after said member is inserted into said sleeve; and (d) joining said sleeve ends together after the ends of said member are welded together.

18. The method of claim 17 including the step of using a lubricating powder to facilitate insertion of said member into said sleeve.

19. The method of claim 17 including the step of thermally protecting said sleeve ends during said welding by forcing said sleeve ends apart a sufficient distance so that the ends of said member are welded together and bringing thereafter said sleeve ends back together when the weld has cooled.

* * * * *